United States Patent [19]

Johnson

[11] 4,151,772

[45] May 1, 1979

[54] SLICING MACHINE

[75] Inventor: Arthur A. Johnson, Mokena, Ill.

[73] Assignee: Chemetron Corporation, Chicago, Ill.

[21] Appl. No.: 877,835

[22] Filed: Feb. 15, 1978

[51] Int. Cl.[2] ..... B26D 7/06; B26D 5/20

[52] U.S. Cl. ..... 83/355; 83/418; 83/422

[58] Field of Search ..... 83/422, 418, 355, 72, 83/420

[56] References Cited

U.S. PATENT DOCUMENTS

| | | | |
|---|---|---|---|
| 2,060,540 | 11/1936 | Straeten | 83/355 |
| 3,354,920 | 11/1967 | Hertwig | 83/418 |
| 3,880,035 | 4/1975 | Divan | 83/422 |

*Primary Examiner*—Donald R. Schran
*Attorney, Agent, or Firm*—Vincent G. Gioia

[57] ABSTRACT

A machine for continuously conveying slabs of meat, such as bacon, to a revolving blade and slicing same into accurate, weight controlled groupings, preferably by control of the conveying system. The machine has a plurality of longitudinally spaced, generally transversely extending rollers and a plurality of finger means mounted on the front roller that is adjacent to the blade, but rearward of the front roller, to apply downward and rearward forces to the conveyor supported slab to positively control the slab travel to, and particularly adjacent, the blade.

7 Claims, 7 Drawing Figures

SLICING MACHINE

BACKGROUND OF THE INVENTION

1. Field of the Invention

This invention pertains to slicing machines.

2. Description of the Prior Art

A conventional continuous slicing machine utilizes a lower, endless conveyor to convey the slabs to the blade over a suitable anvil of substantially the same elevation as the conveyor. Inasmuch as the drive roller of the conveyor has to be set rearwardly of the anvil, the conveyor cannot impart any action to the slab when the last few inches of a slab are located thereon. As a consequence, the slabs are located in abutting end to end relationship so that the adjacent end of a slab on the conveyor will force the slab end on the anvil into the blade for a continuous slicing operation. Of course any means located above the conveyor and in contact with the slab, which may also encompass a tractor means operating at the same speed as the conveyor, cannot control the action of the slab end on the anvil or the slab where the tractor means is not coextensive with the conveyor. Thus, the usual involute type blade having a portion of its periphery cut away so that the slab can move therethrough for positioning before cutting the next slice, has a tendency to pull the slab end thereto, thereby varying slice thickness. The action of the involute blade is such that the blade initially contacts the transverse center of the slab and moves downwardly starting at the tending side of the machine and moving gradually toward the drive side where the last end of the slab is sliced and somewhat lifted adjacent an upraised side guide. It is seen, therefore, that not only does the blade pull the slab end longitudinally thereto, but also tends to twist the slab end toward the side guide. Controlling the cutting of the last slices of the slab end on the anvil in particular, presents the greatest difficulty in maintaining uniform slices although the blade effect must also be considered for slicing the slab in general where not controlled by the tractor means.

The conventional continuous slicing machine utilizes the aforementioned tractor means located above the conveyor to contact the slab and to drive the slab with the lower conveyor to the blade. A floating mounting of the tractor means accommodates changes in slab thickness. For control of the slab end on the anvil, the machine utilizes a plurality of spring loaded finger means on pivots with another plurality of vertically movable weighted, finger means effective adjacent the blade with both type finger means, being located forwardly of the tractor means. A side finger means is also utilized to maintain the slabs against the side guide.

Although the slicing machine detailed above has been used for some time, it has not produced the uniformity in slices desired, even with the numerous slab controls. It is felt that this is due primarily to the remoteness of the tractor means drive roller from the blade which may be 10 inches. Thus, the control forward of this roller, including the anvil, is entirely accomplished by the weight loaded finger means each of which has 2 lbs. per finger load adjacent the blade and the spring load of 5-6 lbs. remote therefrom. Also the drive roller of the conveyor is located 6 inches from the blade, requiring an unduly long anvil.

SUMMARY OF THE INVENTION

Applicant, as a consequence, designed a continuous slicing machine that largely avoids the disadvantages of the prior art and produces more uniform slices not only from the slab in general but the slab end on the anvil. This slicing machine via a suitable conveyor control system adapted for use therewith, therefore, produces more uniform slices throughout the entire slicing operation.

Specifically, Applicant has relocated the drive roller of the conveyor to within 2½ inches of the blade thereby producing an anvil length of only about 2 inches. More importantly, Applicant, has designed a new hold down device, in lieu of the tractor means with a floating mount, which includes a plurality of longitudinally spaced, generally transversely extending rollers pivotally mounted on the machine frame generally coextensive with the conveyor for applying downward and rearward forces to the slab. Since generally coextensive with the lower conveyor, the slabs are positively held thereto during the slicing operation. Also due to the pivotal mounting, the machine can accommodate slabs of varying elevations with the thickest slices receiving the greater control near the blade. For the slab ends moving from beneath the hold down device and onto the anvil, Applicant has provided a plurality of finger means mounted on the front roller that is adjacent the blade but rearwardly of the front roller. The spring relieved finger means extend forward of the roller to contact the slab end on the anvil immediately adjacent the blade and are guided in a vertical plane to accommodate changes in thickness of the slabs. Because of the unique mounting of the finger means, the front roller is moved much closer to the blade than in the past providing positive slab control with the conveyor by the use of preferably air cylinders for an adjustable and adequate desired load. The finger means slidable mounting between the front roller and the second roller is necessary to allow the positioning of the pivotable front roller in the location formerly used by the finger means mounting arrangements. Also an idler pivotal mounting resists twisting of the finger means.

Applicant's design has provided a significant improvement in securing uniform slices while the slab is under control of the hold down device, due to its substantial coextensiveness with the conveyor, and also, when only the slab end is held by the finger means on the substantially reduced length anvil. This is due to the greater loads possible and utilized on the finger means due to the mounting on the air cylinder pivoted front roller (although relieved by the individual springs) which is approximately 84 lbs. for all of the fingers compared to 32 lbs. for the prior art. As noted, this greater load is also concentrated in a much smaller area due to the shorter length of anvil which in turn is due to the reduced distance to the drive roller of the conveyor.

It is, therefore, an object of this invention to provide a new and improved slicing machine.

Another object of this invention is to provide an improved slicing machine having a continuous feed provision that provides more effective control over the slabs to be sliced up to, and at, the slicing blade.

DESCRIPTION OF THE PREFERRED EMBODIMENT

Figure 1:
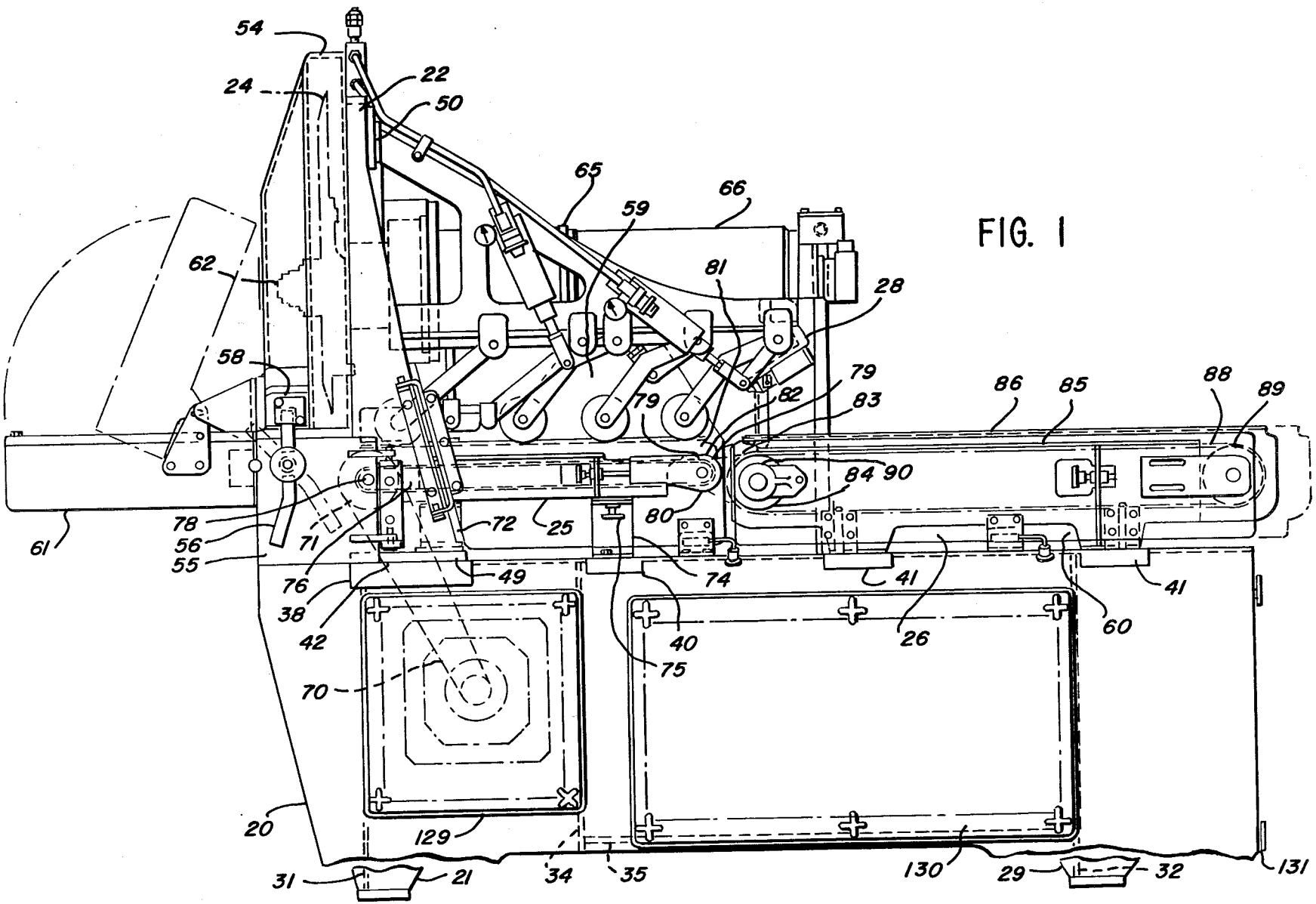
FIG. 1 is a side elevational view of the slicing machine of this invention.
Figure 2:
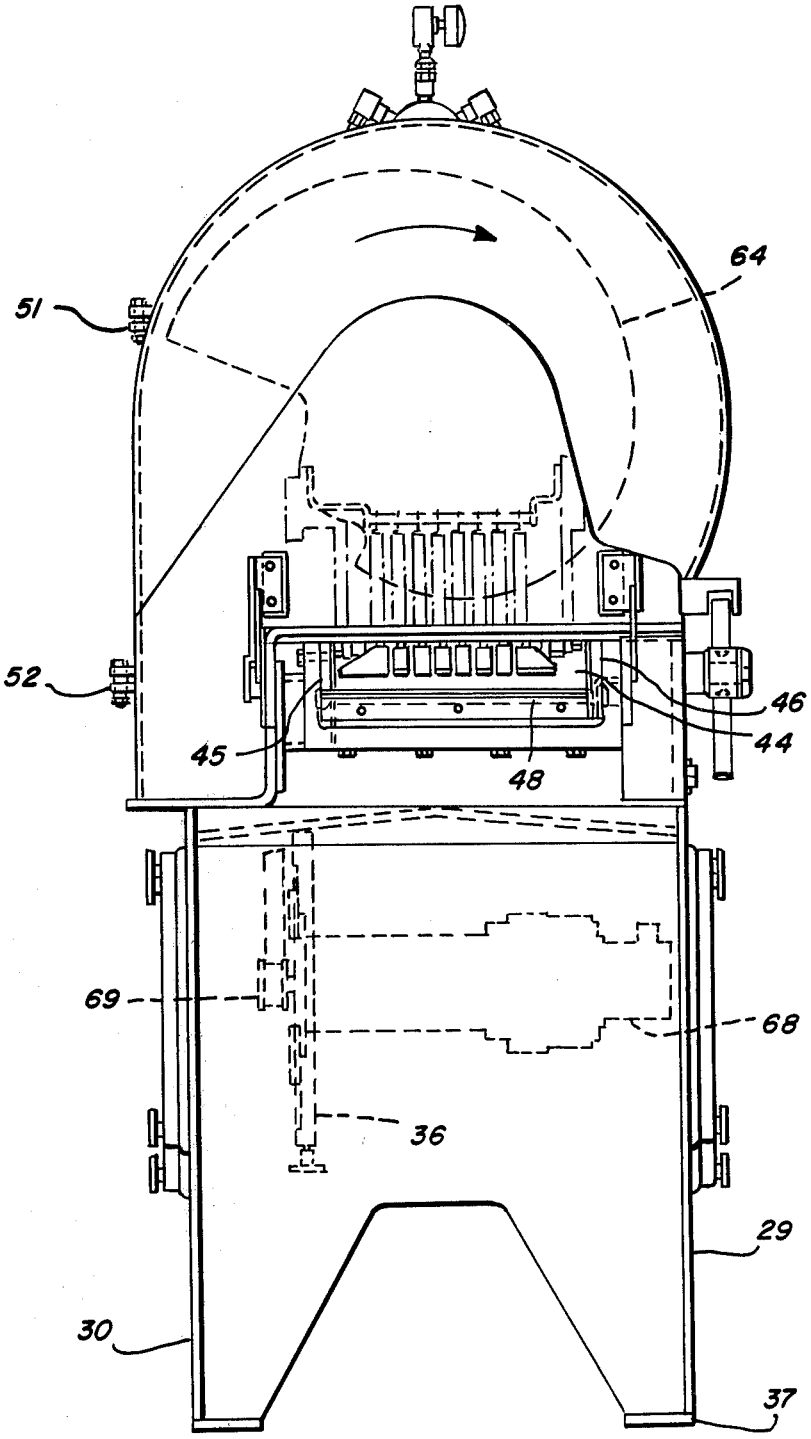
FIG. 2 is an end view showing the slicing portion of the machine.

Referring to FIGS. 1 and 2, 20 indicates a slicing machine for slicing bacon slabs or the like. Machine 20 includes a lower base assembly 21, an upper base assembly 22, a blade assembly 24, a front conveyor assembly 25 (adjacent to the blade assembly), a rear conveyor assembly 26, and what may be denominated, a top hold down assembly 28.

Lower base assembly 21, as shown best in FIGS. 1 and 2, includes plate 29 which is located on what may be denominated the front or tending side of the machine. Plate 29 extends the full length of the machine and over the top of the base assembly to join opposite hand plate 30 located on the rear or drive side. End reinforcements such as plate 31 on the end of the machine generally adjacent the slicing blade and plate 32 connect plates 29 and 30 into a rigid box like structure. Internal reinforcing elements such as 34, 35, and 36 provide bracing for assembly 21 and support for the drive portions of the various assemblies. Typical block 37, which may have suitable holes, is provided to rigidly fasten assembly 21 to the floor.

Lower base assembly 21 also has an upper mounting block 38 for upper base assembly 21 that extends the width of the assembly. Located rearwardly of block 38 are spaced rear pads 40 for front conveyor 25 and rearwardly thereof are spaced support blocks 41 for rear conveyor 26.

Figures 3, 7:
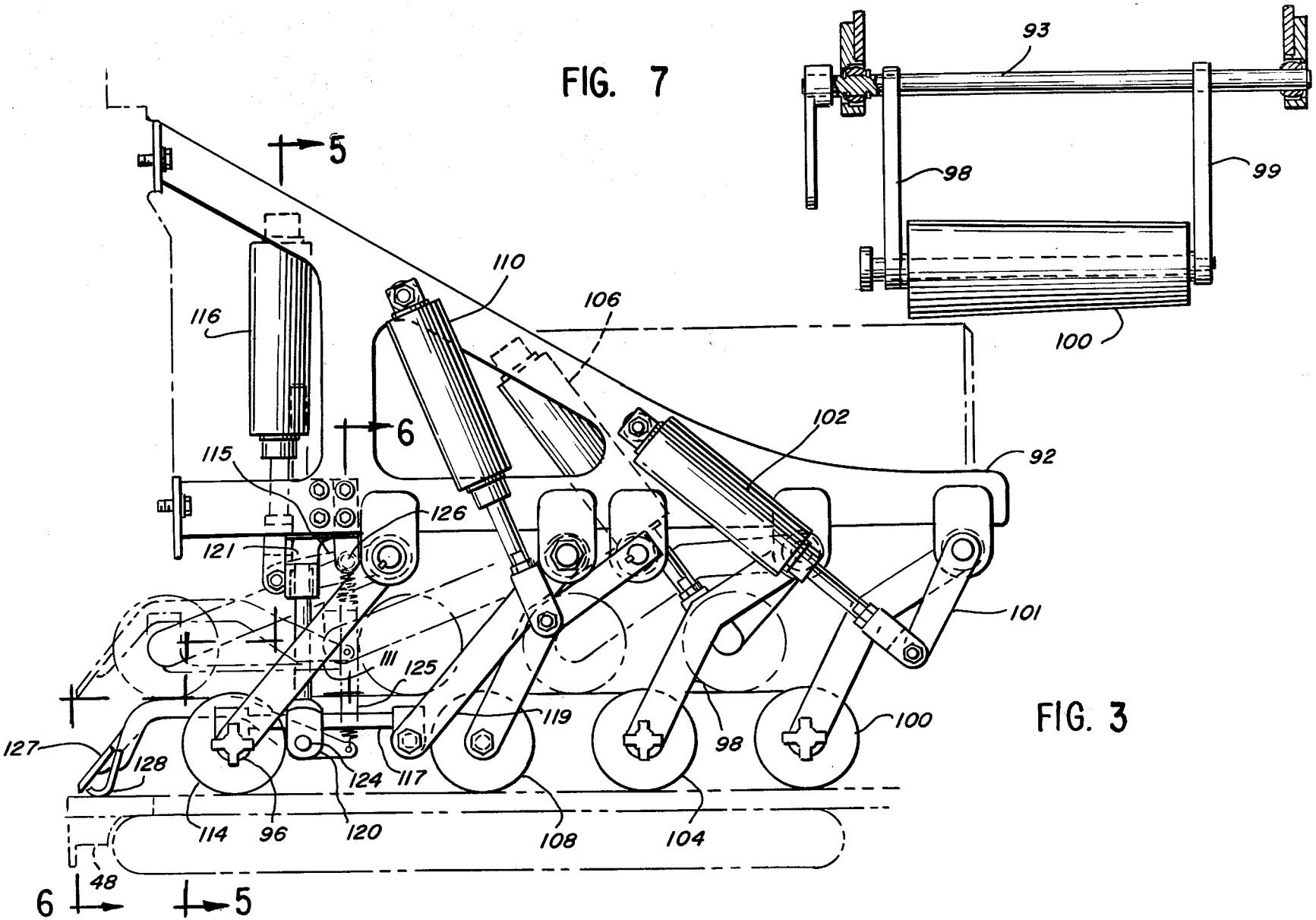
FIG. 3 is an enlarged elevational view, similar to FIG. 1, showing the upper hold down assembly.
FIG. 7 is an end view of the hold down assembly.
Figure 4:
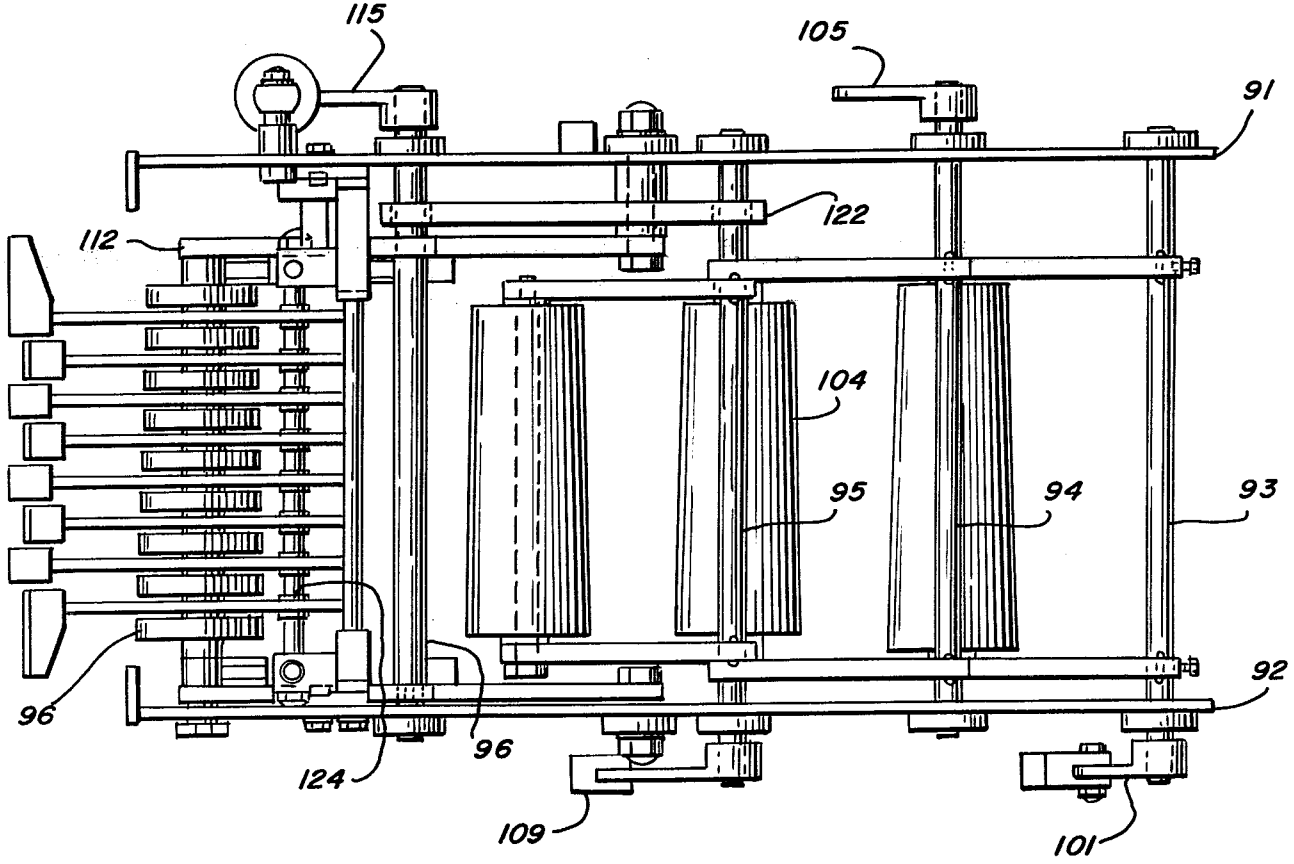
FIG. 4 is a plan view of the hold down assembly of FIG. 3.

Upper base assembly 22, which is firmly attached to lower base assembly 21 on the upper mounting block 38, consists essentially of blade or knife head weldment 42. Weldment 42 has a lower opening 44 for passage therethrough of the slabs and an upper mounting portion for the blade assembly 24. Opening 44 has side shear edges 45 and 46 and lower shear edge or anvil 48 (also see FIG. 3) located adjacent blade travel and extending rearwardly therefrom. Generally rearward of anvil 48 are pads 49 located on weldment 42 and aligned with opening 44 for the front support of front conveyor assembly 25. Also located on weldment 42 on the rear side thereof are spaced upper pads 50 and lower pads (not shown) for the support of hold down assembly 28 which is utilized for use with the front conveyor. To meet safety requirements, various guards are provided to shield blade operation and also the action of the hold down assembly and the conveyors. Specifically, weldment 42 has upper and lower mountings 51 and 52 on the drive side for knife guard 54. Guard 54 is maintained in the closed position by lock 55 hinged to weldment 42 having latch 56 adapted to engage cam lock 58 which is affixed to guard 54. Lock 55 due to its hinged mounting also provides access to the lower blade area. Also pivitally mounted on weldment 42, is guard 59 which encloses front conveyor 25 and hold down assembly 28. Suitable magnetic latches maintain guard 59 in the closed position. Guard 60 via suitable mounts on lower base assembly 21 restricts access to rear conveyor 26. Guard arrangement 61 is pivotally mounted on knife guard 54 to substantially surround opening 44 when in the lowered position. Also rotatably mounted in weldment 42 via shaft 62 is blade assembly 24.

Blade assembly 24, having involute blade 64 (See FIG. 2) includes a front bearing assembly which is enclosed in weldment 42. Rear bearing assembly, enclosed in shaft housing 65, which is rigidly attached to weldment 42, provides support for a D.C. electric motor 66 which is therefore supported in a cantilever mounting arrangement. A suitable coupling connects the electric motor drive shaft to shaft 62.

Front conveyor 25 provides the tractive power to move the slab to the blade 64 via electric motor 68 which is mounted internally in lower base assembly 21 on reinforcement 36. Via a suitable sprocket 69, and timing belt 70, motor 68 drives front sprocket 71 of conveyor 25 which is located on the drive side of the machine. Belt 70 passes through aligned suitable openings in weldment 42 and lower base assembly 21 for access to sprocket 71. Conveyor 25 is mounted on pads 49 in weldment 42 via a typical front bracket 72 and to lower base assembly 21 via a typical rear bracket 74. Conventional front threaded adjustment (not shown) and rear adjustment 75 connected to the conveyor frames allow transverse tilting of the conveyor. Via typical support 76 connected to side frames, front sprocket 71 and therefore related drive shaft assembly 78 for support belt 79 can be adjusted relative to blade 64. Drive tension is maintained on belt 79 by an adjustable mounting of rear idler shaft assembly 80. Also a part of front conveyor 25 is drive side guide 81 which extends the length of the conveyor and is adjustably connected to the associated conveyor side frame. Connected to the drive side of rear idler shaft 80 is drive sprocket 82, which via belt 83 drives the drive side sprocket 84 of rear conveyor 26.

Rear conveyor 26 is somewhat similar to front conveyor 25 and although driven by same, through a choice of sprockets, has a higher conveyor lineal speed than that of the front conveyor 25. The purpose of this arrangement is to continually move the slabs into abutting relationship on conveyor 25 for a continuous slicing operation. Rear conveyor 26 includes tending side frame 85 having mounting portion for attachment to typical support blocks 41 of lower base assembly 21. Tending side frame 85 is lower in elevation than drive side frame 86. Conveyor belt 88 is tensioned by an adjustable mounting of driven roller 89 in conjunction with drive roller 90. No provision is made for tilting transversely rear conveyor 26 as compared with front conveyor 25 wherein due to tapered rollers of the hold down assembly 28, slabs are continually moved toward the drive side for slicing by the blade. To enhance this movement, a side finger means may be utilized to move the slabs toward the higher drive side guide 81 of front conveyor 25.

Hold down assembly 28, which represents Applicant's primary contribution is shown best in FIGS. 1, 3, 4, 5, 6 and 7. Assembly 28 includes drive side frame 91 and tending side frame 92. Each frame has upper and lower mounting pads for connection to the rear of weldment 42 via suitable capscrews. Providing rigidity to the weldment-frames assembly are spaced shafts 93, 94, 95 and 96 extending between the frames 91 and 92. Rearward shaft 93 is connected to the frames by suitable spherical bearings with the tending side frame preventing transverse machine movement due to the spherical mounting and because of suitable retainers as shown best in FIG. 7. Arms 98 and 99 are mounted on shaft 93 for rotation therewith by suitable keys and support rotatably mounted roller 100. Roller 100 is tapered to a smaller diameter in the direction of the drive side of the machine. Further roller 100 has longitudinally extending grooves (along the shaft) to combat fat build-up. Crank 101 is pinned at one end to shaft 93 and is attached via a clevis to single acting air cylinder 102 mounted on frame 92.

Forward of shaft 93 is shaft 94 which is similarly connected to frames 91 and 92 as shaft 93 but with the bearings reversed. Arms 98 and 99 are also mounted on shaft 94 for rotation therewith and support rotatably mounted roller 104. Roller 104 is similarly tapered and grooved as roller 100. Crank 105 is pinned to shaft 94 but located on the drive side and is connected via a clevis to single acting air cylinder 106 mounted on frame 91.

Forward of shaft 94 toward the blade is located shaft 95 which is similarly connected to frames 91 and 92. Arms 98 and 99 are also mounted on the shaft for rotation therewith and support rotatably mounted roller 108 having the features of the other rollers. Crank 109 pinned to shaft 95 on the tending side is connected by a clevis to single acting air cylinder 110 mounted on frame 92.

Similarly, front roller shaft 96 mounted on frames 92 and 91 by similar bearings has arms 111 and 112 mounted on the shaft for rotation therewith and which rotatably support roller 114. Roller 114 besides being tapered as are the other comparable rollers also is composed of a plurality of spaced tapered discs interposed by non-tapered smaller periphery rollers, the purpose of which will be detailed later in this specification. Crank 115 attached to single acting air cylinder 116 located on frame 91 is attached to activate the roller by a suitable clevis. Mounted on the shaft of front roller 114 at both ends thereof are horizontal bar assemblies 117 and 118. Each bar assembly includes a bar pinned to the housing of and extending rearwardly of roller 114 and to a second housing similarly mounted on the idler arm 119. Slidably located on each bar assembly is a vertical guide 120 having a vertical portion adapted to engage a suitable vertical tube 121 located thereabove on both frames. Idler arms 119 are mounted at the other ends on frames 91 and 92 by suitable shoulder bolts. The bar of each bar assembly therefore moves forward and aft with the movement of arms 119 and arms 111 and 112. However, movement of vertical guides in a vertical direction is maintained by tubes 121. Bracket assembly 122 located inward of frame 91 is connected to shafts 95 and 96 to provide rigidity to the idler arm connection particularly to rear frame 91.

Vertical guides 120 also have a lower pivot shaft 124 therethrough that extends substantially the width of the slicing machine and serves as a fulcrum for a plurality of generally two different types of spaced finger means which are adapted to contact the slabs on the anvil. Springs 125 connected to the finger ends rearwardly of the shaft 124 extend upwardly and are connected to upper shaft 126 mounted on frames 91 and 92. The type of fingers having a relatively sharp edge located adjacent the blade are labeled 127 and the rearward fingers having a curved edge are denoted as 128. Preferably dual springs are used on the finger immediately adjacent the rear guide to prevent lift up of the bacon slab by the knife at this point. Regardless of the movement of the pivotally mounted front roller, the finger means remain spaced the same distance rearward of the blade and on the anvil 48.

Figure 5:
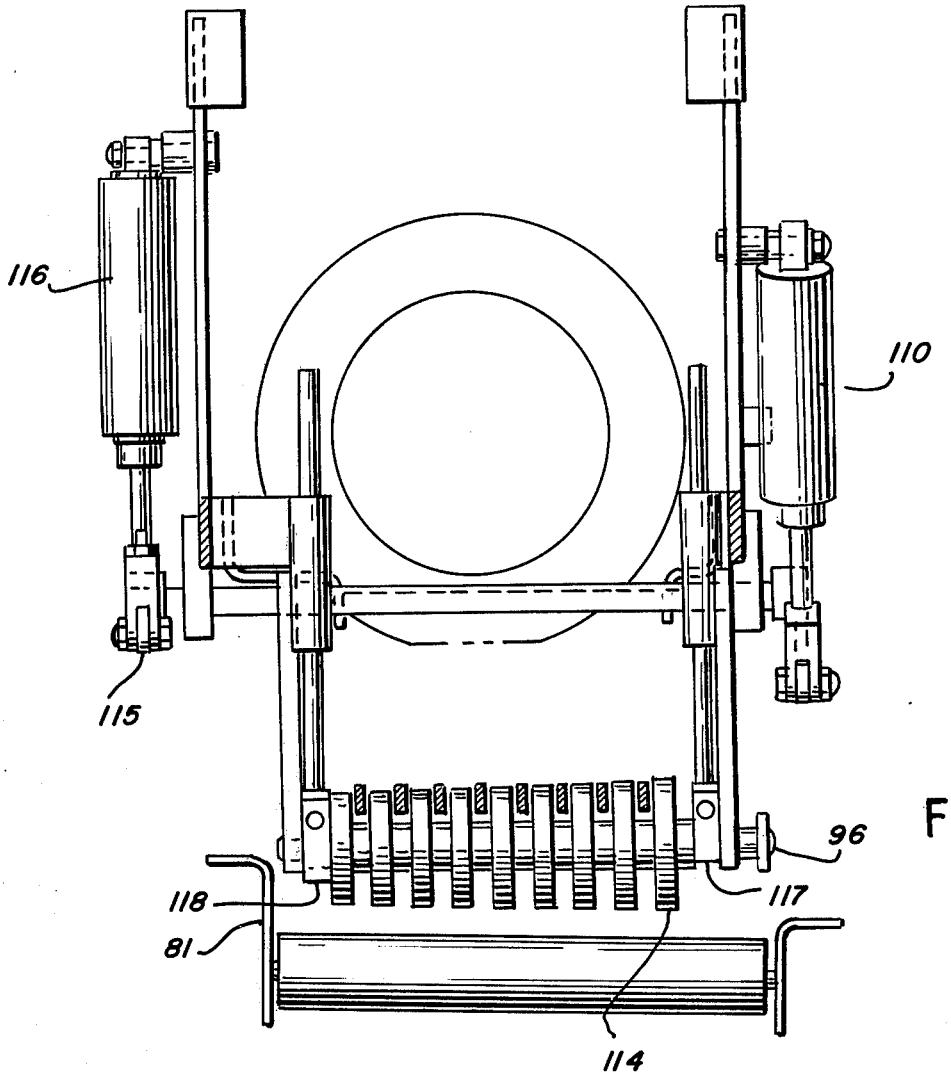
FIG. 5 is a sectional view taken along line 5—5 of FIG. 3.
Figure 6:
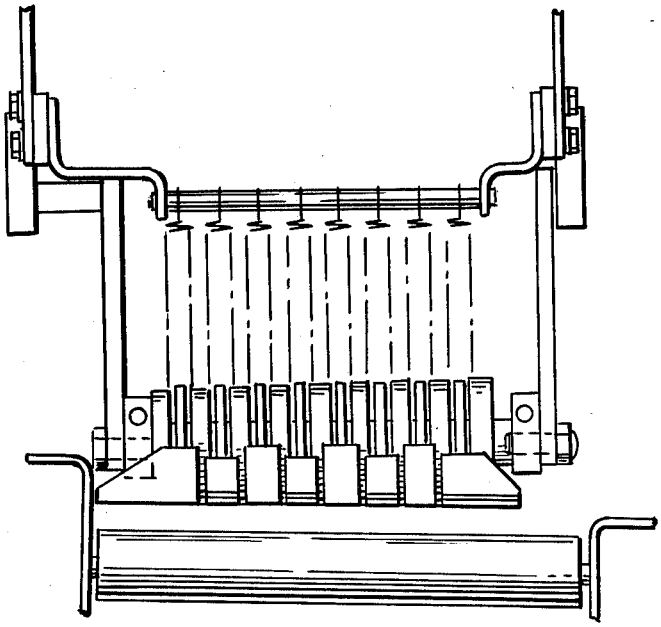
FIG. 6 is a sectional view taken along line 6—6 of FIG. 3.

Since the mounting of both types of finger means are rearwardly of the front roller, the fingers of both extend through the front roller 114 via the non-tapered spacers to contact the slab on the anvil (see FIG. 5).

Referring to FIG. 1, suitable removable covers 129 and 130 are provided on the tending side of machine 20 and also on the driving side for access to the interior of the machine and its components therein. A suitable cover 131 is also removably mounted on the rear of the machine.

In operation (see FIG. 1 and FIG. 3) slabs of material (such as bacon) of a size of about ¾" thick to 4" high and 12" wide are placed on rear conveyor assembly 26 which has been energized via the drive connection with front conveyor 25 which is driven by energized electric motor 68 located in the forward part of the machine. Electric motor 69 has previously been energized to rotate blade 64. Due to the faster conveyor speed of rear conveyor 26, the slabs on the front conveyor are pushed forwardly and maintained in an abutting relationship on the front conveyor 25 for a continuous slicing operation by the blade 64. As the slabs are moved on to the front conveyor they are contacted by the rollers (starting from the rear) 100, 104, 108, and front roller 114. The associated air cylinders have been actuated and via the respective cranks of 101, 105, 109 and crank 115 the respective arms and rollers are forced down into contact with the slabs exerting downward and contrary forces to that applied by belt 79 of conveyor 25. The air pressure control can be varied up to a pressure up to 300 psi as desired. Especially in FIG. 3, as shown in dotted lines for thicker slabs, front roller 114 closely approaches the front end of conveyor 25 and even in the lower condition, is essentially coextensive in length and width with the lower conveyor. Thus all slabs thereon are positively controlled therebetween to reduce the pull by the blade toward same in the slicing operation and also to reduce the twisting effect of the blade especially toward the drive side on which is mounted elevated side guide 80 for uniform slices. As mentioned previously, the rollers have longitudinal grooves to counteract the tendency of fat build up from the slabs to enhance the holding effect of the rollers. Also as mentioned previously, the front conveyor (as shown in FIG. 5) is lowered toward the tending side, parallel with the tapered rollers to cause the rollers to exert a tendency to move the slabs toward the side guide 81. If need be, this can be aided by a single spring loaded finger (not shown) to aid in maintaining the slab against the side guide 81. Of course the pivotal mounting of the rollers allows the slicing of slabs of varying thicknesses with the front roller in this case applying the pressure closest to the anvil 48.

As the slabs move out from between the front roller 114 and on to the reduced length anvil 48, the finger means assemblies exert a downward and rearward force thereon which is less than that exerted by the front roller but more than in the prior art. Specifically, horizontal bar assembly 118 (located on both sides of the machine) which is attached to front roller shaft 96 and extends rearwardly to connect to idler arm 119 with a shaft in between has a vertical guide 120 that moves slidably on the shaft for forward and aft movement and moves vertically in guide tube 121 located on the frame 92 of the hold down assembly. Inasmuch as assembly 118 also has a transversely extending shaft 124 between the hold down frames, plurality of finger-means 127 and 128 pivotally mounted thereon exert a downward and rearward force on the slab end on the anvil by virtue of the action of front roller 114. Individual springs attached to each finger means and connected to shaft 125 relieve the finger load as desired. It is to be noted that due to the vertical travel of the finger means via bar assembly 118 as vertical guide 120 moves in tube 121, both fingers means 127 and 128 remain in the same vertical plane over the reduced length anvil and immediately adjacent the blade. Due to the varying and substantial force that can be applied in this area of approximately an 1½", even these small bacon ends are controlled insofar as practical from the knife effect to maintain relatively uniform slices in this portion of the slab.

Particularly on start up and shut down, the sliver (reduced) slices encountered can be avoided by judicious control of conveyor travel in regard to blade position to eliminate this source of loss. And due to the effective hold down device the control system can produce uniform slices due to the effective roller and finger control of the slabs to, and at, the blade.

Having thus described the invention, it will be apparent to those skilled in the art that various changes and modifications can be made without departure from the spirit of the invention or the scope of the appended claims.

I claim:

1. A slicing machine comprising:

(a) a support frame:

(b) a slicer blade mounted for rotation on said frame;

(c) an anvil mounted on said frame adjacent said blade;

(d) an endless conveyor mounted on said frame for feeding a slab of material forwardly over said anvil into the path of rotation of said blade;

(e) a plurality of longitudinally spaced, generally transversely extending rollers pivotally mounted on said frame above said conveyor and generally coextensive with said conveyor for applying downward and rearward forces to the slab;

(f) a plurality of finger means slidably mounted on the front roller adjacent said blade, but rearwardly of said front roller for movement therewith, said finger means extending forwardly of said front roller toward said blade to contact the slab; and (g) means for biasing said rollers and therefore said finger means toward the slab to control slab travel to said knife.

2. The slicing machine of claim 1 further comprising guide means for restricting travel of said finger means to substantially a vertical plane.

3. The slicing machine of claim 2 in which the pivotal mounting of said first roller comprises a first pair of spaced links and a second pair of rearwardly mounted links, each pair of links being connected by a pair of shafts and said plurality of finger means are mounted on said shafts.

4. The slicing machine of claim 3 in which each of said plurality of finger means are aligned generally transversely of said conveyor and are individually biased toward the slab.

5. The slicing machine of claim 4 in which said first roller comprises a plurality of spaced roller portions and each of said finger means extends between said portions.

6. The slicing machine of claim 5 further comprising a side guide means and in which each of said rollers is tapered and has its smallest diameter adjacent said side guide means and said conveyor is mounted parallel to said rollers for movement of the slab toward said side guide means.

7. The slicing machine of claim 6 in which said means for biasing said rollers is a single acting air cylinder for each roller.

* * * * *